US011035351B2

(12) United States Patent
Andersen et al.

(10) Patent No.: US 11,035,351 B2
(45) Date of Patent: Jun. 15, 2021

(54) HYDRAULIC MACHINE

(71) Applicant: Danfoss A/S, Nordborg (DK)

(72) Inventors: Stig Kildegaard Andersen, Nordborg (DK); Georg Herborg Enevoldsen, Nordborg (DK); Sveinn Porarinsson, Reykjavik (IS)

(73) Assignee: DANFOSS A/S, Nordborg (DK)

( * ) Notice: Subject to any disclaimer, the term of this patent is extended or adjusted under 35 U.S.C. 154(b) by 163 days.

(21) Appl. No.: 16/254,955

(22) Filed: Jan. 23, 2019

(65) Prior Publication Data

US 2019/0234388 A1 Aug. 1, 2019

(30) Foreign Application Priority Data

Jan. 31, 2018 (DE) ..... 102018102091.0
Apr. 23, 2018 (DE) ..... 102018109630.5

(51) Int. Cl.
*F04B 11/00* (2006.01)
*F04B 1/20* (2020.01)
(Continued)

(52) U.S. Cl.
CPC ..... *F04B 11/0091* (2013.01); *F01B 3/0047* (2013.01); *F01B 3/0055* (2013.01);
(Continued)

(58) Field of Classification Search
CPC .... F04B 1/2042; F04B 1/2021; F04B 1/2014; F04B 1/205; F04B 1/2057; F04B 3/0055;
(Continued)

(56) References Cited

U.S. PATENT DOCUMENTS 3,037,489 A * 6/1962 Douglas ..... F03C 1/0655 91/485
3,200,761 A 8/1965 Firth et al.
(Continued)

FOREIGN PATENT DOCUMENTS

CN 205117703 U 3/2016
DE 1453467 A1 12/1968
(Continued)

*Primary Examiner* — Dustin T Nguyen
(74) *Attorney, Agent, or Firm* — McCormick, Paulding & Huber PLLC

(57) ABSTRACT

A hydraulic machine is described comprising a first part (1, 4) and a second part (7, 8), wherein the first part (1, 4) and the second part (7, 8) are movable relatively to each other in abutting relation, the first part (1, 4) comprises a pressure chamber (2) having a pressure chamber opening (6) in a contact face (5) contacting a sealing face (9) of the second part (7, 8), the second part (7, 8) comprises a low pressure area (10) connected to a low pressure opening (11) in the sealing face (9) and a high pressure area (12) connected to a high pressure opening (13) in the sealing face (9), wherein during a movement of the first part (1, 4) with respect to the second part (7, 8) in a moving direction (14) the pressure chamber opening (6) comes alternatingly in overlap with the low pressure opening (11) and the high pressure opening (13). Such a machine should be flexible in operation with low risk of damages caused by cavitation. To this end a throttling channel (15) in the second part (7, 8) connects the low pressure area (10) with an area in the sealing face (9) in moving direction in front of the low pressure opening (11).

16 Claims, 2 Drawing Sheets

(51) Int. Cl.

| | |
|---|---|
| ***F04B 1/2014*** | (2020.01) |
| ***F03C 1/06*** | (2006.01) |
| ***F04B 1/2021*** | (2020.01) |
| ***F01B 3/00*** | (2006.01) |

(52) U.S. Cl.
CPC ..... *F03C 1/0647* (2013.01); *F04B 1/20* (2013.01); *F04B 1/2014* (2013.01); *F04B 1/2021* (2013.01)

(58) Field of Classification Search
CPC .... F04B 3/0047; F03C 1/0636; F03C 1/0435; F03C 1/0438; F03C 1/0441; F03C 1/0444; F03C 1/0647; F03C 1/0649; F03C 1/0655; F03C 1/0657; F03C 1/066
See application file for complete search history.

(56) References Cited

U.S. PATENT DOCUMENTS

| | | | | | |
|---|---|---|---|---|---|
| 3,585,901 | A * | 6/1971 | Moon, Jr. | F04B 1/2021 | 91/6.5 |
| 3,699,845 | A * | 10/1972 | Ifield | F04B 1/2042 | 91/6.5 |
| 3,956,969 | A | 5/1976 | Hein | | |
| 4,920,856 | A * | 5/1990 | Berthold | F04B 1/2042 | 91/499 |
| 6,024,541 | A * | 2/2000 | Perstnev | F04B 1/2042 | 417/203 |
| 8,047,120 | B2 * | 11/2011 | Shinohara | F04B 1/2042 | 91/6.5 |
| 2014/0150640 | A1 * | 6/2014 | Hofmann | F04B 1/2042 | 91/491 |

FOREIGN PATENT DOCUMENTS

| | | | |
|---|---|---|---|
| DE | 2038086 | A1 | 2/1972 |
| DE | 2129781 | A1 | 12/1972 |
| DE | 19706114 | C2 | 2/2001 |
| DE | 69501855 | T3 | 5/2001 |
| DE | 69611839 | T2 | 8/2001 |
| DE | 10209805 | A | 10/2002 |
| DE | 102012104923 | A1 | 12/2013 |
| JP | H08159011 | A | 6/1996 |
| JP | H08232834 | A | 9/1996 |
| JP | 2000073939 | A | 3/2000 |
| JP | 2000345955 | A | 12/2000 |
| JP | 2002031039 | A | 1/2002 |
| JP | 5732080 | B2 | 6/2015 |

* cited by examiner

HYDRAULIC MACHINE

CROSS-REFERENCE TO RELATED APPLICATION

This application claims foreign priority benefits under U.S.C. § 119 to German Patent Application No. 102018102091.0 filed on Jan. 31, 2018, and German Patent Application No. 102018109630.5 filed on Apr. 23, 2018, the content of each is hereby incorporated by reference in its entirety.

TECHNICAL FIELD

The present invention relates to a hydraulic machine comprising a first part and a second part, wherein the first part and the second part are moveable relative to each other in abutting relation, the first part comprises a pressure chamber having a pressure chamber opening in a contact face contacting a sealing face of the second part, the second part comprises a low-pressure area connected to a low-pressure opening in the sealing face and a high-pressure area connected to a high-pressure opening in the sealing face, wherein during a movement of the first part with respect to the second part in a moving direction the pressure chamber opening comes alternatingly in overlap with the low-pressure opening and the high-pressure opening.

BACKGROUND

Such a hydraulic machine is realized, for example, by an axial piston machine which can be in form of a pump or a motor. The pressure chamber is in form of a cylinder in which a piston is moved to vary the volume of the pressure chamber. The cylinder is arranged in a cylinder block. When the cylinder block rotates the pressure chamber opening is moved over the low-pressure opening and over the high-pressure opening, wherein the low-pressure opening and the high-pressure opening are usually in the form of kidneys.

When the machine is used as a pump, the volume of the pressure chamber is decreased as long as the pressure chamber opening is in fluid connection with the high-pressure area and the volume of the pressure chamber is increased as long as the pressure chamber opening is in fluid connection with the low-pressure area.

The pressure chamber, or in other words, the cylinder volume, transitions between high-pressure and low-pressure and vice versa. During a transition, the pressure chamber disconnects from one pressure level and is sealed by the construction of the machine until it connects to the other pressure level. The periods where the pressure chamber is sealed occur just after the bottom dead center or maximum volume (low-pressure to high-pressure transition) and just after the top dead center or minimum volume (high-pressure to low-pressure transition). During the periods where the pressure chamber is sealed the pressure in the pressure chamber will change because the volume is changing. In the axial piston machine the piston does not stop movement. Accordingly, the movement of the piston will "pre-compress" the volume of the pressure chamber before it connects to the high-pressure side. Just after the top dead center, the movement of the piston will "de-compress" the volume of the pressure chamber before it connects to the low-pressure side.

The transition from high-pressure to low-pressure is critical with respect to avoiding cavitation damage.

On one hand, it must be avoided that the pressure in the pressure chamber is too high when it connects to the low-pressure side. This is necessary to avoid that explosive decompression causes an under-shoot in the pressure in the volume of the pressure chamber, which will generate cavitation bubbles. Furthermore, there is a risk that a high-pressure jet into the low-pressure opening is generated and this high-pressure jet can also lead to cavitation damage. On the other hand, it is also critical to avoid that de-compression due to the movement of the piston continues for too long and causes the pressure to drop as low as the vapor pressure as this can also lead to the formation of cavitation bubbles.

Presently, in axial piston pumps the pressure variation in the pressure chamber is controlled by means of the angular extent of the period after the top-dead-center in which the pressure chamber is sealed. This is referred to as "timing". If the angular extend is too short then the pressure in the pressure chamber will be too high when it connects to the low-pressure area. If the angular extend is too long, then the pressure will drop too much before the pressure chamber connects to the low-pressure area. In an axial piston machine timing is dependent on the swash plate angle because the magnitude of the motion during the period in which the pressure chamber is sealed is roughly proportional to a swash plate angle.

Similar problems occur in connection with pressure exchangers, in which the same conditions between low-pressure and high-pressure and vice versa must be handled. There is no volume change. Pressure is controlled with throttling.

In general, the geometry of the machine must be adapted to the working speed and to the pressure of the machine and variations of these parameters increase the risk of cavitation.

Cavitation is a cause of damages which are in particular detrimental in the sealing surface and the contact surface. Such damage could negatively influence the efficiency of the machine.

SUMMARY

The object underlying the invention is to have a hydraulic machine which is flexible in operation with low risk of damages caused by cavitation.

This object is solved with a hydraulic machine as described at the outset in that a throttling channel in the second part connects the low-pressure area with an area in the sealing face in moving direction in front of the low pressure opening.

The throttling channel forms a throttling connection between the pressure chamber and the low-pressure area before the pressure chamber opening comes in overlapping relation with the low pressure opening. Accordingly, a pressure equalization between the pressure chamber and the low-pressure area can take place before the pressure chamber opening connects to the low pressure opening. The pressure in the pressure chamber produces a jet of fluid through the throttling channel into the low-pressure area. If cavitation bubbles are generated by the jet of fluid, they can implode in the low-pressure area away from any surfaces so that the risk of damage is comparatively low.

In an embodiment of the invention a local throttling resistance of the throttling channel increases in a direction away from the sealing surface. The effect of this increase is that a speed of the fluid flow increases in the throttling channel and the pressure decreases from the sealing surface to the low-pressure area with the effect that cavitation bubbles cannot collapse inside the channel.

In an embodiment of the invention a cross-section flow area of the throttling channel decreases in a direction away from the sealing surface. This is a simple way to increase the local throttling resistance of the throttling channel.

In an embodiment of the invention the throttling channel has a conical form. This is a simple way to decrease the cross-sectional flow area.

In an embodiment of the invention the throttling channel has a main flow direction which at least at an opening in the low-pressure area is inclined or perpendicular with respect to the sealing surface. A high-pressure jet of fluid is directed away from the sealing surface and any cavitation bubbles that may form near the jet will collapse far away from any surface which is used for sealing purposes.

In an embodiment of the invention the opening into the low-pressure area has a distance to the sealing surface which is at least as large as the smallest diameter of the throttling channel. The high-pressure jet that exits the throttling channel is sufficiently far away from the sealing surfaces.

In an embodiment of the invention a second throttling channel in the second part connects the high pressure area with an area in the sealing face in moving direction in front of the high-pressure opening. The second throttling channel has a similar effect as the previously mentioned throttling channel which can be named "first throttling channel". The pressure equalization between the high-pressure area and the pressure chamber takes place before the pressure chamber comes into overlapping relation with the high pressure opening.

In an embodiment of the invention a local throttling resistance of the second throttling channel increases in a direction towards the sealing surface. Accordingly, the flow of fluid is increased when the fluid passes the second throttling channel and the pressure of the fluid is correspondingly reduced.

In an embodiment of the invention a cross-section flow area of the second throttling channel decreases in a direction towards the sealing surface. This is a simple way to increase the local throttling resistance.

In an embodiment of the invention the second throttling channel has a conical or stepped form. In the last case the diameters of the throttling channel in each step decreases. This is a simple way to decrease the cross-section flow area of the second throttling channel.

In an embodiment of the invention the second throttling channel has a main flow direction which at least at an opening in the sealing face is inclined or perpendicular with respect to the sealing surface. Accordingly, the jet of fluid escaping from the second throttling channel is directed away from the sealing surface.

In an embodiment of the invention an opening of the second throttling channel into a sealing surface has a distance to the high-pressure opening which is at least as large as the smallest diameter of the second throttling channel. Accordingly, even if the flow of fluid through the second throttling channel produces cavitation bubbles they are far enough away from the sealing surface to minimize the risk of damage.

In an embodiment of the invention the second part comprises a first element in contact with the first part and a second element on a side of the first element opposite the first part wherein the throttling channel passes through both elements. In other words, the throttling channel comprises a first section in the first element and a second section in the second element. Preferably the flow resistance in the first section is less than in the second section. This ensures that the pressure in the connection channel does not get so low that cavitation bubbles can form in the throttling channel. The throttling channel can have a throttle in the second element defining the flow resistance. This embodiment also reduces the costs and complexity of the first element, because it does not need to contain an accurately defined throttling channel. This is an advantage because the first element contacting the first part is a wear part that will need to be replaced at regular intervals whereas the second element does not need to be replaced regularly.

In an embodiment of the invention in the first element the throttling channel runs at least partly perpendicular to the contact face. This simplifies the production of the first element.

In an embodiment of the invention a muffler chamber is arranged within the throttling channel. When the connection between the cylinder volume and the muffler chamber forms, a fast pressure equalization occurs between the cylinder volume and the muffler chamber so that the combined volume quickly reaches an intermediate pressure between the high-pressure and the low-pressure. A slower equalization between the intermediate pressure in the muffler chamber and the pressure in the suction kidney then follows through the throttling channel. The advantages of having the muffler chamber are reduced formation of cavitation bubbles, reduced pulsations on the low-pressure side, and reduced noise for the pump.

In an embodiment the throttling channel passes through a nozzle element. The throttling function can be placed in a separate component, namely the nozzle element, to enable easier manufacturing of the throttling function. Having the nozzle or the throttling element as a separate component also enables tuning of pumps to specific operationing conditions by changing only the nozzle element. This possibility can also be used to reduce the number of variants of first elements or second elements needed to cover a wide range of applications, because the differences in functionality of the first element variants, can, to some extent, be replaced by combining a single first element with different nozzle elements.

BRIEF DESCRIPTION OF THE DRAWING

An embodiment of the invention will now be described in more detail with reference to the drawing, in which.

Same elements are denoted with the same reference numerals in all figures.

DETAILED DESCRIPTION

Figure 1:
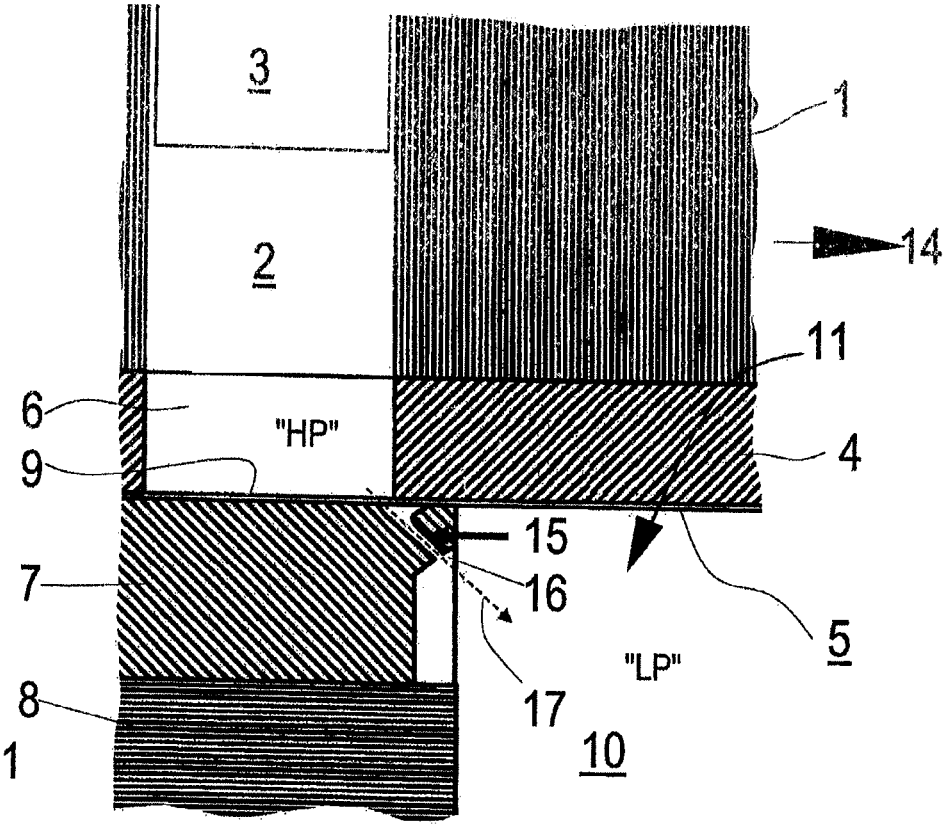
FIG. 1 shows a schematic sketch of a cut-view through a part of an axial piston pump in transition from high-pressure to low-pressure.

The figures show schematically parts of an axial piston pump, in particular a cylinder block 1 in which at least one cylinder 2 forms a pressure chamber having a variable volume. The variable volume is caused by a piston 3 which is moved in the cylinder 2 when the cylinder block 1 rotates.

In an axial piston pump the movement of the cylinder is caused by a swash-plate which is not shown.

A valve plate 4 is secured to the cylinder block 1. The valve plate 4 comprises a contact face 5 on a side opposite to the cylinder block 1. For the purpose of the following illustration the cylinder block 1 and the valve plate 4 are considered as a "first part" since both elements 1, 4 are secured to each other and move together.

The cylinder 2 has a pressure chamber opening 6 which is arranged in the valve plate 4.

The valve plate 4 is in contact with a port plate 7 which is secured to a housing 8. Port plate 7 and housing 8 are for the purpose of the following illustration considered as a "second part" since these two elements 7, 8 are fixed to each other. The port plate comprises a sealing face 9 at the side facing the cylinder block 1. The sealing face 9 contacts the contact face 5.

The housing 8 comprises a low pressure area 10 which is connected to a low pressure opening 11 in the port plate 7 and accordingly in the sealing face 9.

Figure 2:
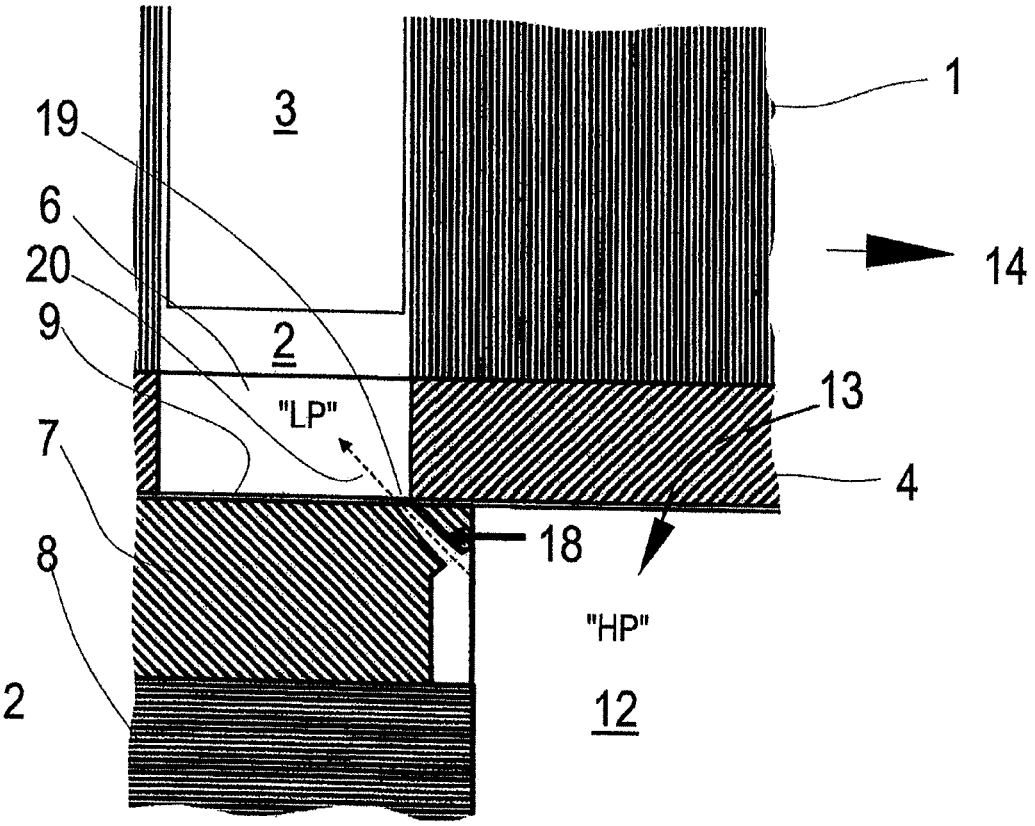
FIG. 2 shows a sketch of a cut-view through parts of an axial piston pump for transition between low-pressure and high-pressure.

As shown in FIG. 2, the housing 8 comprises a high-pressure area 12 which is connected to a high-pressure opening 13 in the port plate 7 and accordingly in the sealing face 9.

FIG. 1 shows a transition between high-pressure and low-pressure. The cylinder block 1 moves in a moving direction 14 which is symbolized by an arrow with respect to the second part formed by the port plate 7 and the housing 8. This movement is a rotational movement around an axis which is not shown. While the cylinder volume is in contact with a high pressure kidney (not shown), the piston 3 moves in a direction towards the second part formed by port plate 7 and the housing 8 to decrease the volume of the pressure chamber in the cylinder 2 to arrive at the bottom dead center. After reaching the bottom dead center the piston 3 will reverse its movement. Since the movement to increase the volume of the pressure chamber in the cylinder 2 takes place during a time in which the pressure chamber opening 6 is sealed by the port plate 7, the pressure in the cylinder 2 decreases but is still higher than the pressure in the low-pressure area 10.

In order to enable a pressure equalization before the pressure chamber opening 6 comes in overlapping relation with the low-pressure opening 11, a first throttling channel 15 is provided in the port plate 7, i.e. in the second part. The throttling channel 15 connects the low-pressure area 10 with an area in the sealing face 9 which is in moving direction 15 in front of low-pressure opening 11.

The first throttling channel 15 has a local throttling resistance which increases in a direction away from the sealing surface 9. The local throttling resistance is the resistance of small sections of first throttling channel 15 in lengthwise direction. A simple way to realize such increase of the local throttling resistance is to decrease a cross-section flow area of the first throttling channel 15 in a direction away from the sealing surface 9. The first throttling channel 15 can have a conical form to realize this increasing local throttling resistance.

The first throttling channel 15 is inclined with respect to the sealing surface 9. It can be at least partly be perpendicular to the sealing surface. An opening 16 of the first throttling channel 15 into the low pressure area 10 has a distance from the sealing surface 9 which is at least as large as the smallest diameter of the throttling channel to achieve a sufficient distance between the opening 16 and the sealing surface 9, for example five times the smallest diameter.

As soon as the pressure chamber opening 6 connects to the first throttling channel 15 a jet 17 of hydraulic fluid forms which is directed into the low-pressure area 10. Since the first throttling channel 15 is inclined with respect to the sealing surface 9 the jet 17 is directed away from the sealing surface 9 and from the contact surface 5. Due to the increasing throttling resistance the velocity of the fluid during travel through the first throttling channel 15 increases and accordingly the pressure of the fluid in the jet 17 decreases so that the risk of implosion of bubbles is minimized. Even if cavitation bubbles form near the jet, they will collapse far away from any surface. When cavitation bubbles collapse far from surfaces they cannot cause cavitation erosion damage.

The first throttling channel 15 has the advantage that the flow rate through the first throttling channel 15 depends on the pressure difference between the pressure chamber in the cylinder 2 and the low-pressure area 10. If this pressure difference is high then the flow rate will be high and vice versa. That means that the approach of the pressure in the cylinder 2 to the pressure in the low-pressure area 10 by means of the first throttling channel 15 becomes somewhat self-regulating.

A similar solution is realized on the "other side" of the machine, i.e. at the transition between low-pressure and high-pressure. This is shown in FIG. 2. A second throttling channel 18 connects the high pressure area 12 and the sealing face 9 in an area in front of the high-pressure opening 13 in moving direction 14.

The second throttling channel 18 has a local throttling resistance which increases in a direction towards the sealing surface 9. This can be realized by decreasing the cross-section flow area which can in a simple way be realized by forming the second throttling channel 18 in a conical form.

The second throttling channel 18 as well is inclined or at least partly perpendicular with respect to the sealing surface 9. An opening 19 of the second throttling channel 18 into the sealing surface 9 has a distance to the high-pressure opening 13 which is at least as large as the smallest diameter of the second throttling channel 18, for example five times the smallest diameter.

When the pressure chamber opening 6 connects to the opening 19 of the second throttling channel 18, a jet 20 of hydraulic fluid forms which is directed into the pressure chamber opening 6 and into the cylinder 2.

Due to the decreasing cross-section flow area of the second throttling channel 18 the fluid continuously accelerates along the length of the second throttling channel 18. Therefore, the pressure keeps decreasing along the length of the second throttling channel 18, so that any cavitation bubbles that may form inside the second throttling channel 18 cannot collapse until they are clear of the opening 19 or muzzle of the second throttling channel 18.

The cross-section of the throttling channel 15, 18 can be quite small compared to the diameter of the piston 3 they will have a maximum cross-section of 4% or less of the diameter of the piston 3.

The invention has been described using an axial piston machine as example.

The invention can also be applied to other hydraulic machines such as an isobaric pressure exchanger.

When the invention is used in a pressure exchanger which has no piston, there is no variable volume of the pressure chamber. However, the transition between low pressure and high pressure and vice versa causes similar problems.

Figure 3:
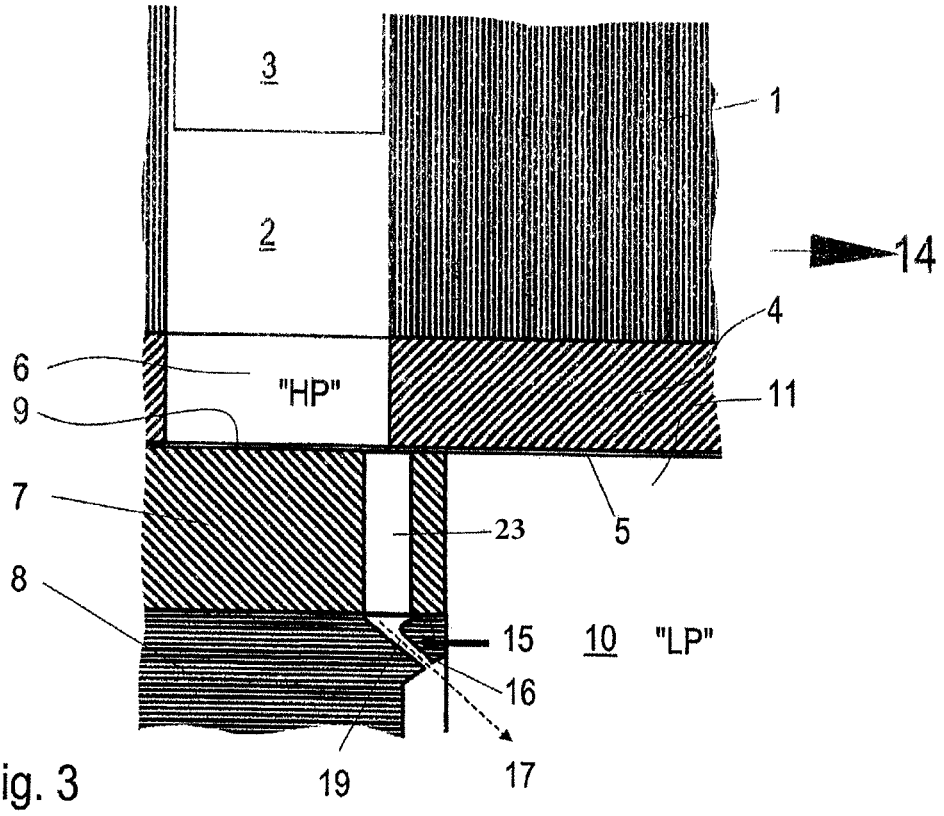
FIG. 3 shows a schematic sketch of a cut-view through a part of a second embodiment of an axial piston pump in transition from high-pressure to low-pressure and FIG. 4 shows a schematic sketch of a cut-view through a part of a third embodiment of an axial piston pump in transition from high-pressure to low-pressure.

FIG. 3 shows a second embodiment of the axial piston pump in transition from high-pressure to low-pressure.

As mentioned above, the second part comprises the port plate 7 as first element and the housing 8 as second element.

In this embodiment the throttling channel 15 comprises a first channel part 23 in the port plate 7 and a second channel part 19 in the housing 8. The first channel part 23 runs perpendicular to the contact face 5. This simplifies the production of the port plate 7. The first channel part 23 has a flow resistance less than the second channel part 19. The relation of the flow resistances ensures that the pressure in the connection channel 15, in particular in the first channel part 23, does not get so low that cavitation bubbles can form in the throttling channel. This embodiment reduces the cost and complexity of the port plate 7, because it does not need to contain an accurately manufactured throttling channel with a defined flow resistance. This is an advantage because the port plate 7 is a wear part that will need to be replaced at regular intervals whereas the housing or port flange does not need to be replaced regularly.

Figure 4:
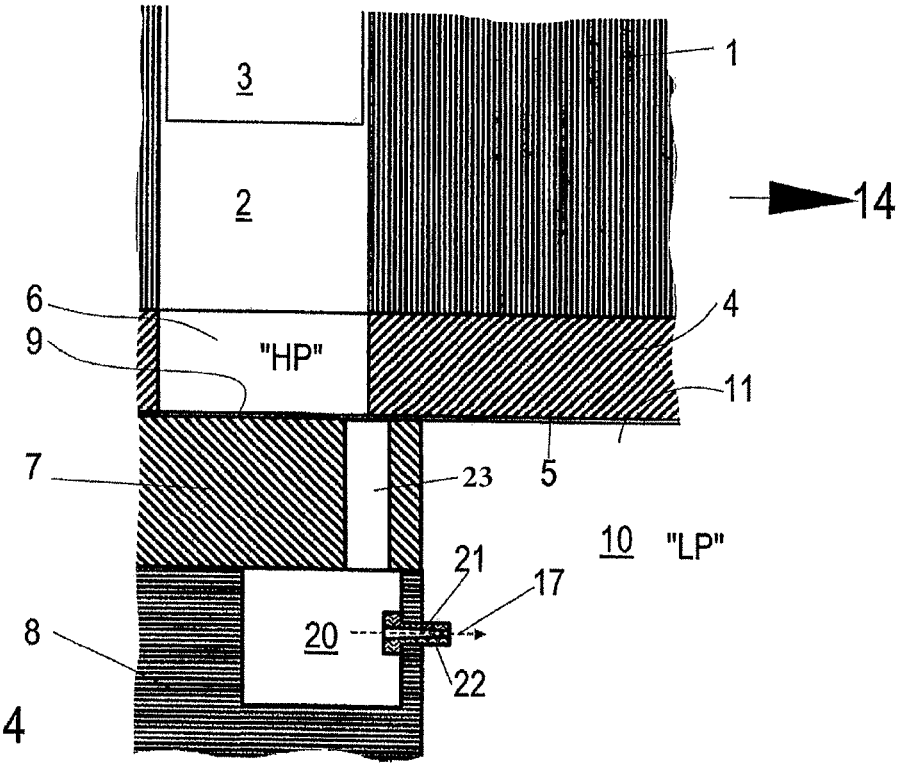

FIG. 4 shows a third embodiment of an axial piston pump in transition from high-pressure to low-pressure.

In this embodiment the throttling channel comprises the first channel part 23, a muffler chamber 20 and a nozzle 21 which is provided in a separate nozzle element 22. It should be noted that such a nozzle element 22 can be provided in the embodiments according to FIGS. 1 to 3 as well.

The muffler chamber 20 has the effect that a fast pressure equalization occurs between the volume of the cylinder 2 and the muffler chamber 20, when the connection between the cylinder volume and the muffler chamber 20 forms, so that the combined volume quickly reaches an intermediate pressure between the high-pressure and the low-pressure. A slower equalization between the intermediate pressure in the muffler chamber 20 and the pressure in the low-pressure area 10 then follows through the nozzle 21.

The advantages of having the muffler chamber 20 are reduced formation of cavitation bubbles, reduced pulsations on the low pressure side, and reduced noise for the pump.

When the additional nozzle element 22 is used, the nozzle function can be realized in a way which is easier to manufacture.

Having the nozzle 21 in a separate nozzle element 22 also enables tuning of the pumps to specific operation conditions by changing only the nozzle element 22. This possibility can also be used to reduce the number of variants of port plates 7 needed to cover a wide range of applications, because the differences in functionality of the port plate variants can, to some extent, be replaced by combining a single port plate 7 with different nozzle elements 22.

It should be noted that in the embodiments shown in FIGS. 3 and 4 the jet 17 is located so far from the valve plate 4 that it would be acceptable to direct it parallel to the valve plate 4 without risking that the cavitation bubbles ejected from the throttling channel 15 will damage the valve plate 4.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic machine comprising a first part and a second part, wherein the first part and the second part are movable relatively to each other in abutting relation, the first part comprises a pressure chamber having a pressure chamber opening in a contact face contacting a sealing face of the second part, the second part comprises a low pressure area connected to a low pressure opening in the sealing face and a high pressure area connected to a high pressure opening in the sealing face, wherein during a movement of the first part with respect to the second part in a moving direction the pressure chamber opening comes alternatingly in overlap with the low pressure opening and the high pressure opening, wherein a throttling channel in the second part connects the low pressure area with an area in the sealing face in moving direction in front of the low pressure opening, wherein the throttling channel passes through a nozzle element, wherein the nozzle element is a separate component from the second part, and wherein the nozzle element is removable or replaceable from the second part.

2. The hydraulic machine according to claim 1, wherein a local throttling resistance of at least a portion of the throttling channel increases in a direction from a high pressure area side of the portion of the throttling channel towards a low pressure area side of the portion of the throttling channel.

3. The hydraulic machine according to claim 2, wherein a cross section flow area of at least a portion of the throttling channel decreases in a direction from a high pressure area side of the portion of the throttling channel towards a low pressure area side of the portion of the throttling channel.

4. The hydraulic machine according to claim 3, wherein at least a portion of the throttling channel has a conical or stepped form.

5. The hydraulic machine according to claim 2, wherein at least a portion of the throttling channel has a conical or stepped form.

6. The hydraulic machine according to claim 1, wherein the throttling channel has a main flow direction which at least at an opening in the low pressure area is inclined or perpendicular with respect to the sealing surface.

7. The hydraulic machine according to claim 6, wherein the opening into the low pressure area has a distance to the sealing surface which is at least as large as the smallest diameter of the throttling channel.

8. The hydraulic machine according to claim 1, wherein a second throttling channel in the second part connects the high pressure area with an area in the sealing face in moving direction in front of the high pressure opening.

9. The hydraulic machine according to claim 8, wherein a local throttling resistance of at least a portion of the second throttling channel increases in a direction towards the sealing surface.

10. The hydraulic machine according to claim 9, wherein at least a portion of the second throttling channel has a conical form.

11. The hydraulic machine according to claim 8, wherein a cross section flow area of at least a portion of the second throttling channel decreases in a direction towards the sealing surface.

12. The hydraulic machine according to claim 8, wherein the second throttling channel has a main flow direction which is at least at an opening in the sealing face inclined or perpendicular with respect to the sealing surface.

13. The hydraulic machine according to claim 12, wherein the opening of the second throttling channel into the sealing surface has a distance to the high pressure opening which is at least as large as the smallest diameter of the second throttling channel.

14. The hydraulic machine according to claim 1, wherein the second part comprises a first element in contact with the first part and a second element on a side of the first element opposite to the first part, wherein the throttling channel passes through both elements.

15. The hydraulic machine according to claim 14, wherein in the first element the throttling channel runs at least partly perpendicular to the contact face.

16. The hydraulic machine according to claim 1, wherein a muffler chamber is arranged within the throttling channel.

* * * * *